US011642716B2

(12) United States Patent
Lozano Bonet

(10) Patent No.: US 11,642,716 B2
(45) Date of Patent: May 9, 2023

(54) PRESS RAM FOR A FINE BLANKING PRESS

(71) Applicant: Lapmaster Wolters GmbH, Rendsburg (DE)

(72) Inventor: José Lozano Bonet, Rendsburg (DE)

(73) Assignee: Lapmaster Wolters GmbH, Rendsburg (DE)

( * ) Notice: Subject to any disclaimer, the term of this patent is extended or adjusted under 35 U.S.C. 154(b) by 30 days.

(21) Appl. No.: 17/110,556

(22) Filed: Dec. 3, 2020

(65) Prior Publication Data

US 2021/0170472 A1 Jun. 10, 2021

(30) Foreign Application Priority Data

Dec. 5, 2019 (EP) ..... 19213793

(51) Int. Cl.

| | |
|---|---|
| ***B21D 28/00*** | (2006.01) |
| ***B21D 28/26*** | (2006.01) |
| ***B21D 28/16*** | (2006.01) |
| ***B30B 15/04*** | (2006.01) |
| ***B30B 15/06*** | (2006.01) |
| ***B30B 15/00*** | (2006.01) |

(52) U.S. Cl.
CPC ..... *B21D 28/002* (2013.01); *B21D 28/26* (2013.01)

(58) Field of Classification Search
CPC ..... B21D 28/002; B21D 28/26; B21D 28/16; B30B 15/041; B30B 15/065; B30B 15/007; B30B 15/04
USPC ..... 72/455–456
See application file for complete search history.

(56) References Cited

U.S. PATENT DOCUMENTS

| | | | | |
|---|---|---|---|---|
| 4,065,954 | A * | 1/1978 | Gotz | B30B 15/04 100/214 |
| 5,413,018 | A * | 5/1995 | Wada | B26D 5/086 83/466 |
| 2003/0015017 | A1* | 1/2003 | Gubler | B30B 15/041 72/453.13 |
| 2010/0043519 | A1 | 2/2010 | Schaltegger et al. | |

(Continued)

FOREIGN PATENT DOCUMENTS

| | | | |
|---|---|---|---|
| CN | 1198762 | A | 9/1995 |
| CN | 106926509 | A | 7/2017 |

(Continued)

OTHER PUBLICATIONS

CN 202011409537.5, filed Dec. 4, 2020, First Office Action, date of notification Jul. 5, 2022 (11 pages).

(Continued)

*Primary Examiner* — Matthew Katcoff
*Assistant Examiner* — Mohammed S. Alawadi
(74) *Attorney, Agent, or Firm* — Barclay Damon LLP

(57) ABSTRACT

A press ram for a fine blanking press comprises a ram plate section configured to carry a fine blanking tool and at least two guide sections positioned on opposing sides of the ram plate section. The ram plate section comprises an upper surface, a lower surface, and two opposing side surfaces. The at least two guide sections of the ram plate section are configured to guide movement of the press ram relative to a press frame during a fine blanking process. The at least two guide sections extend in a vertical direction to a level that is higher than the upper side of the ram plate section.

8 Claims, 5 Drawing Sheets

(56) References Cited

U.S. PATENT DOCUMENTS

| | | | | |
|---|---|---|---|---|
| 2011/0000349 | A1* | 1/2011 | Schaltegger ..... | B21D 28/16<br>83/55 |
| 2015/0273779 | A1 | 10/2015 | Daub et al. | |
| 2017/0129000 | A1 | 5/2017 | Honegger et al. | |

FOREIGN PATENT DOCUMENTS

| | | | |
|---|---|---|---|
| DE | 202006009222 | U1 | 10/2006 |
| DE | 102007017595 | B3 | 1/2009 |
| EP | 2158982 | A1 | 3/2010 |
| EP | 3115191 | A1 | 1/2017 |

OTHER PUBLICATIONS

EP 19 213 793.3, filed Dec. 5, 2019, Office Action, dated Sep. 2, 2022 (8 pages).

* cited by examiner

PRESS RAM FOR A FINE BLANKING PRESS

CROSS REFERENCE TO RELATED INVENTION

This application is based upon and claims priority to, under relevant sections of 35 U.S.C. § 119, European Patent Application No. 19 213 793.3, filed Dec. 5, 2019, the entire contents of which are hereby incorporated by reference.

TECHNICAL FIELD

The invention pertains to a press ram for a fine blanking press, comprising a ram plate section for carrying a fine blanking tool, and comprising guide sections for guiding ram movement relative to a press frame of the fine blanking press during a fine blanking process, arranged on two opposite sides of the ram plate section. The invention also pertains to a fine blanking press.

BACKGROUND

Fine blanking presses allow blanking parts for example from sheet metal with high quality and flexibility with regard to the design of the parts. Fine blanking presses usually comprise a press ram and a counter unit, such as a working table, arranged opposite the press ram. A fine blanking tool is arranged on the press ram. The fine blanking tool can comprise for example one or more than one press plates or ejectors directly connected by transfer pins to a press cushion of the press ram or a press cushion of the working table or connected to any other cushion or actuator integrated inside the tool itself, as well as one or more than one press punches or press dies. During a fine blanking process, the press ram is driven in a driving movement against the working table wherein process material, such as sheet metal, to be processed is held between the press ram and the working table. During the fine blanking process step, the press ram pushes the working table along its driving direction. The press ram can move relative to press plates or press punches, press dies or others. For blanking a part from the process material for example press punches can move relative to the press ram. Usually, the blanking tool is provided with impingement means, for example an impingement ring, like a V-ring, for securely holding the process material in place. The fine blanking process can also comprise progressive, transfer, rotary or other tooling process steps, wherein a part is blanked performing subsequent movements of press ram and working table. Fine blanking presses are known for example from EP 2 158 982 A1 or EP 3 115 191 A1.

The ram plate section of a press ram is usually provided with guide sections on two opposite sides. These guide sections engage with corresponding guide sections in the press frame for guiding the movement of the press ram during operation of the fine blanking press. Problems can occur in practice when uneven forces act upon components of the fine blanking press. Such uneven forces can occur in particular in progressive tooling. Uneven forces can lead to tilting of the press ram such that the guiding of the press ram on the press frame is negatively affected. This again can result in tool damage, press guiding wear or leakages due to extreme wear of hydraulic drives of the press ram. All this negatively affects the lifetime and performance of the line blanking press as well as the quality of the produced parts.

Starting from the prior art above, it is therefore an object of the invention to provide a press ram and a fine blanking press having reduced wear and risk of damage as well as improved quality of produced parts also under the occurrence of uneven forces.

BRIEF SUMMARY OF THE INVENTION

The invention solves the object in that the guide sections extend to a vertically higher level than the upper side of the ram plate section on both opposite sides of the ram plate section.

According to an embodiment, the guide sections provided on both opposite sides of the ram plate section for guiding vertical movement of the press ram in operation extend vertically higher than the ram plate section, in particular in the direction the process plane, in which process material to be fine blanked is fed and held during a fine blanking step. In this manner an enlarged guiding area is provided between the process plane, where blanking takes place, and the upper side of the ram plate section carrying the fine blanking tool. In particular, the effective guiding area, formed by the engagement of the guide sections with corresponding guide elements of the press frame is considerably larger than the height of the ram plate section. This leads to a more robust guiding, in particular when uneven forces occur, for example in progressive tooling. A better support is achieved between the ram plate section of the press frame and its guide sections. Tilting of the press ram can be minimized. The above mentioned problems of the prior art such as increased wear, risk of damage, and impaired part quality, are reliably avoided. The space between the two press frame sides, in which the press ram is moved up and down, is used partly by the vertically higher extending guide sections according to the invention. The space is thus not available for the fine blanking tool. However, the inventors have found that fine blanking tools of sufficiently small width can be used with no problems such that the width of the press ram need not be essentially enlarged.

The press ram can be moved along the vertical axis by a press drive of the fine blanking press. The press drive can for example be a hydraulic drive comprising a hydraulic cylinder. Of course, other press drives are also possible, for example electrical drives or the like.

According to an embodiment the guide sections can extend at least up to a process plane, in which a process material to be fine blanked is fed and held during a fine blanking step, preferably above the process plane. The guide sections can in particular surpass, i.e. extend above the process plane. The process material can for example be a metal sheet being unwound from a coil and fed in a usually horizontal direction through the fine blanking press. The process plane is thus defined by the plane through which the process material is fed in operation of the fine blanking press. By extending the guide sections up to, or even above the process plane, the strength of the inventive guiding of the press ram can be further improved. Of course it is also possible that the guide sections do not extend up to the process plane, but may at the same time surpass, i.e. extend above the press ram plane.

Especially if the guide sections extend above the process plane, it is further possible, in an embodiment, that the guide sections each comprise a central recess for accommodating a process material to be fine blanked. The recesses can for example be U-shaped and are wide enough such that the process material can be guided through the recesses. One of the recesses is positioned before the fine blanking step and another one is positioned after the fine blanking step.

According to a further embodiment, each of the guide sections can comprise vertically extending guide elements configured to engage corresponding vertically extending guide elements of a press frame of a fine blanking press. The guide elements of the ram plate section and the press frame can comprise for example guide slides or rails engaging one another in operation to guide the vertical movement of the press ram.

In an embodiment, the guide sections may also extend to a vertically lower level than the lower side of the ram plate section on both opposite sides of the ram plate section. This leads to a further improved stability and guiding since the guide sections are also extended below the ram plate section. The press ram can accordingly have a H-shape with the ram plate section forming the horizontal middle part of the H-shape and the guide sections forming the vertical legs of the H-shape.

According to a further embodiment, the guide sections can be arranged symmetrically on both opposite sides of the ram plate section. Of course the guide sections can also be arranged asymmetrically on both opposite sides of the ram plate section.

In an embodiment, the press ram plate and the guide sections can be integrally formed. Alternatively, the press ram plate and the guide sections can be formed separately. Preferably, the position of the guide sections can be adjusted manually or automatically in different vertical positions with respect to the ram plate section, in particular the press ram plane, depending on the process plane. This provides a manual or automatic adjustability of the guide sections to different tool heights, and thus different heights of the process plane.

According to a further embodiment, the press ram and/or the press frame can include adjustable press ram and/or press frame guide elements. In particular, a gap between vertically extending guide elements of the guide sections and vertically extending guide elements of the press ram of the press frame of the fine blanking press can be adjusted manually or automatically. Such adjustment can be based on the guiding elements gap between themselves. At least one actuator can be provided for adjustment of the gap. The actuator can be linked to at least a controller controlling the actuator. Also, at least one sensor can be provided for measuring the gap. The controller may control the actuator on basis of measurement data received from the at least one sensor. The controller may carry out an open loop control or preferably a closed loop control in this regard. The gap adjustment can be done before or during the fine blanking process.

According to a further embodiment, the press ram material can be chosen from the group comprising, but not limited to, steel, such as stainless steel, aluminium or aluminium alloys, titanium, wolfram, or any other metal, combination of any metal alloy and/or any non-metal alloy, further composite materials, such as glass fiber, carbon fiber or kevlar, or carbon fiber, glass fiber, kevlar or others combined with titanium, stainless steel or any other material of any kind, as well but not limited to temperature insulating materials, ceramics, plastics, rubbers and any epoxy chemical-based components. The material can be chosen flexibly depending on the process requirements. For example glass fiber or carbon fiber materials are lightweight and high strength materials. Weight is an important factor considering that the press ram must be accelerated during the fine blanking process which, depending on the mass, can lead to undesired effects of vibrations, material fatigue and press frame oscillation. This also has an undesired influence over the fine blanked part quality as well as the press lifetime and may be avoided or mitigated with the choice of suitable materials. Energy consumption can also be reduced with lightweight materials. Of course, the press ram can also comprise a combination of the mentioned materials.

In addition, the press ram can be formed by several different material substructures and their combinations in order to reduce press ram weight and increase press ram strength, for example but not limited to solid material plate(s), honey comb structures of any material, or any other structure of any kind and for the possible combinations of such structures. These substructures may also act to reduce the weight while increasing the press ram strength and obtaining a high performance press ram. A high performance ram may result in a higher level of dynamics in the fine blanking press, thereby avoiding the undesired effects of a heavy press ram involved in high dynamic movements in fine blanking processes.

According to a further embodiment, the press ram may be produced by a method chosen from the group comprising, but not limited to, forging, casting, welding, 3D-printing, moulding, mould injection, for example carbon fiber or carbon fiber alloys mould injection. Again, the suitable method can be chosen flexibly depending on the requirements. For example 3D-printing, e.g. 3D-metal printing or 3D-fiber printing, allows forming parts that are complex or even impossible to manufacture in other processes, such as casting processes, in particular undercuts or internal structures, such as certain cooling channels.

An embodiment of a fine blanking press comprises a press frame with vertically extending guide elements, and a press ram as described herein. The fine blanking press may further comprise a fine blanking tool carried by the ram plate section of the press ram, and at least a ram cushion.

In an embodiment, the blanking tool can comprise one or more than one press plates or ejectors directly connected by transfer pins to a cushion of the press ram or a cushion of the working table, or connected to any other cushion or actuator integrated inside the tool itself, as well as one or more than one press punches or press dies. A press drive is provided for driving the press ram during a fine blanking process step against the working table. The process material, such as sheet metal, to be processed is held between the press ram and the working table. During the fine blanking process step the press ram can move relative to press plates or press punches, press dies or others. For blanking a part from the process material, for example press punches can move relative to the press ram. The blanking tool may be provided with impingement means, for example an impingement ring, like a V-ring, for securely holding the process material in place. The fine blanking press can also comprise a feeding means configured for feeding the process material through the fine blanking press in the process plane. It can further comprise chopping means configured for chopping scrap material after the fine blanking step. The fine blanking press can also comprise progressive, transfer, rotary or other tooling process components, wherein a part is blanked performing subsequent movements of press ram and working table.

According to a further embodiment, at least one temperature sensor may be arranged on the press ram and/or on the press frame and/or on vertically extending guide elements of the press frame and/or of the press ram and/or on the ram cushion and/or on a press drive for driving the press ram. A temperature sensor on the press drive can for example be arranged on a hydraulic drive or in hydraulic fluid of a hydraulic drive, comprising for example a hydraulic cylinder.

Providing temperature sensors addresses the issue that the temperature of certain components of the fine blanking press changes during the production. At the start of the production for example, the ram plate section of the press ram is at environmental temperature. With ongoing production the ram plate section heats up due to different factors. For example, the temperature of the fine blanking tool increases during production, in particular the cutting components due to the high friction values and forces exerted during the cutting of the process material. Due to the physical contact between the fine blanking tool and the ram plate section this temperature is at least partly transferred to the ram plate section. Furthermore, any hydraulic components incorporated into the ram plate section, for example a hydraulic ram cushion, lead to a further increase in temperature of the ram plate section due to heating up of the hydraulic fluid during operation. The thermal energy of the hydraulic fluid is again at least partly transferred to the ram plate section due to physical contact. The change in temperature of press components, such as the ram plate section, during operation leads to several problems. On the one hand the volume of the corresponding press components increases with increasing temperature. This can lead to changes in the engagement between the guide sections of the press ram and corresponding guide sections of the press frame. At worst, the temperature increase can lead to a blocking of the guiding function. Trying to counteract this problem by providing larger tolerances between the engaging guide sections would lead to an inferior guiding function especially at lower temperatures at the beginning of the process. Also, larger tolerances have a negative effect on the accuracy of the movement of the press components, and thus of the fine blanking process. Essentially, the engagement of the guide sections of the press ram on the one hand and the press frame on the other hand will have to be configured for a certain temperature of the engaging components. The problem is further increased by the fact that different processes with different fine blanking tools and different process materials to be fine blanked lead to different thermal behaviour, making a targeted configuration for a certain temperature even more difficult. Providing temperature sensors according to the above embodiment provides information about relevant temperature changes and allows counter measures, as will be explained in more detail below.

Apart from temperature sensors, it can be beneficial to provide further sensors to obtain further information and control over the fine blanking process. For example, at least one pressure sensor may be arranged on the press ram and/or on the press frame and/or on vertically extending guide elements of the press frame and/or of the press ram and/or on the ram cushion and/or on a press drive for driving the press ram.

With such pressure sensors, the loads acting on components fitted with pressure sensors can be monitored and undesired loads, for example higher loads than usual, can be detected. In particular, providing pressure sensors allows a direct monitoring of the loads rather than indirect determinations, for example by checking oil pressure or forces by indirect calculation, or by monitoring for example a torque of a drive motor. Such indirect measurements will give an indication of an unusual deviation in the process. However, they will not give information where exactly the cause for this deviation lies. This information can be obtained for example through appropriate pressure sensors and can be used to influence the process in a desired manner in order to achieve optimum part quality and process.

According to a further embodiment, at least one acceleration sensor may be arranged on the press ram and/or on the press frame and/or on vertically extending guide elements of the press frame and/or of the press ram and/or on the ram cushion and/or on a press drive for driving the press ram. With such sensors it is possible not only to control if accelerations or decelerations are within the desired range, but also to dynamically influence fine blanking press parameters to adapt the accelerations in order to achieve a particularly smooth fine blanking process. Also, adaptations with regard to changes in the process material can be carried out.

According to a further embodiment, at least one strain gauge or deformation sensor may be arranged on the press ram and/or the press frame and/or on vertically extending guide elements of the press frame and/or of the press ram and/or on the ram cushion and/or on a press drive for driving the press ram. With strain gauge sensors it is possible to monitor a possible shape deformation of certain components due to exerted forces during operation, as well as due to temperature variations. Again, this information can be used to influence the process in a desired manner in order to achieve optimum part quality and process.

According to a further embodiment, one or more deformation actuators can be provided and configured to deform the profile or shape of the press ram, or its components, before or during the fine blanking process. Such a deformation actuator may be integrated or included in the press ram. However, additionally or alternatively it could also be an external deformation actuator connected to the press ram. Such a deformation actuator can be controlled by a controller, in particular based on measurement data received from a sensor. The deformation actuator can be for example, but not limited to, hydraulic, electrical or pneumatic cylinder, piezo electric actuator, or others to deform actively controlled the press ram profile or shape before or during the fine blanking process. In this manner the press ram deformations generated for example by thermal changes, material stress or fatigue, can be compensated. Also, the cyclic or permanent deformations generated by the high forces exerted over certain areas of the press ram during certain press ram movements like, but not limited to, acceleration movements, blanking movement during the fine blanking process, more specifically, but not limited to, while cutting the raw material by means of a tool, can be actively compensated. The deformation actuators can be connected to a controller while the controller is connected to at least a sensor, the corresponding sensor(s) of any kind, like for example strain gauge or deformation sensors, position sensors, acceleration sensors or any other type of sensors. The controller can exert the corresponding adjustments over the press ram profile or shape through the actions of at least a controlled actuator or different controlled actuators. The controller can carry out an open loop control or preferably a closed loop control. Again, it is possible to influence the process in a desired manner on this basis.

According to a further embodiment, at least one position sensor may be arranged on the press ram and/or the press frame and/or on vertically extending guide elements of the press frame and/or of the press ram and/or on the ram cushion and/or on a press drive for driving the press ram. With such position sensors it is possible to dynamically monitor component positions during the line blanking process and to influence the process in a desired manner on this basis.

According to a further embodiment, at least one fluid pressure sensor may be arranged on the press frame and/or of the press frame and/or on vertically extending guide elements of the press frame and/or of the press ram and/or on the ram cushion and/or on a press drive for driving the press ram. Such fluid pressure sensors allow to dynamically monitor for example fluid pressures in press drives, cooling channels, lubrication channels for guide sections, such as slides or rails, or in ram cushion cavities, ram plate section fluid channels or others. Again, it is possible to influence the process in a desired manner on this basis.

According to a further embodiment, at least one fluid viscosity sensor may be arranged on the press ran and/or on the press frame and/or on vertically extending guide elements of the press frame and/or of the press ram and/or on the ram cushion and/or on a press drive for driving the press ram. Such fluid viscosity sensors allow to dynamically monitor for example fluid viscosities at different fluid temperatures in press drives, cooling channels, lubrication channels for guide sections, such as slides or rails, or in ram cushion cavities or ram plate section fluid channels and others. Again, it is possible to influence the process in a desired manner on this basis.

According to a further embodiment, at least one fluid flow sensor may be arranged on the press ram and/or on the press frame and/or on vertically extending guide elements of the press frame and/or of the press ram and/or on the ram cushion and/or on a press drive for driving the press ram. Such fluid flow sensors allow to dynamically monitor for example fluid flow volumes in press drives, cooling channels, lubrication channels for example for guide sections, such as slides or rails, or in ram cushion cavities or ram plate section fluid channels and others. Again, it is possible to influence the process in a desired manner on this basis.

According to a further embodiment, at least one wear sensor may be arranged on the press ram and/or on the press frame and/or on vertically extending guide elements of the press frame and/or of the press ram and/or on the ram cushion and/or on a press drive for driving the press ram. Such wear sensor(s) allows to dynamically monitor the wear of specific components for example the guide elements, like slides, rails or any other. Such sensor(s) can be linked to a controller and the corresponding actuator(s) in order to compensate possible wear and possibly apply preventive actions to reduce future wear like for example increasing the dynamic lubrication over the affected component. Again, it is possible to influence the process in a desired manner on this basis.

According to a further embodiment, a controller may be provided which receives measurement data from at least one sensor and preferably all sensors. The controller is configured to control the fine blanking press on basis of the measurement data received, preferably by means of an open loop control, more preferably by means of a closed loop control. Of course, one or more than one controller may be provided. As already explained, on basis of the measurement data of the sensors it is possible to control the press operation such that data measured by the respective sensors can be kept within a target range. In particular, the controller can carry out an open loop control in a most simple embodiment or, preferably, an (active) closed loop control on basis of the received measurement data. This embodiment allows using the measurement data obtained by the sensors to advantageously influence the operation of the fine blanking press, leading to an improved process and quality of the produced parts.

According to a further embodiment, the controller may be configured to control the temperature of and/or forces exerted on or by and/or pressures exerted on or by and/or deformations exerted on or by components of the fine blanking press, such as the press ram and/or its press ram components and/or a press frame and/or guide sections and/or their guide elements and/or a ram cushion and/or a press drive for driving the press ram, wherein the controller receives measurement data of at least one sensor, preferably all sensors, and wherein at least one actuator is provided, which is controlled by the controller on basis of measurement data received from the at least one sensor, preferably by means of an open loop control, more preferably by means of a closed loop control.

According to a further embodiment, at least one cooling channel for a cooling fluid may be provided in the press ram and/or in the press frame and/or on the ram cushion and/or in the vertically extending guide sections of the press frame and/or of the press ram. Such cooling channels can be formed particularly easily with a 3D-printing process, moulding process, mould injection process, casting, or others. In operation, a cooling fluid of any kind, such as water, glycol or others can flow through the cooling channels to regulate the temperature of certain press components while one or more than one sensors of any kind like for example temperature sensors, flow sensors, pressure sensors, viscosity sensors or other sensors are applied to monitor and control all the needed parameters while such sensors are connected to a controller that at the time is controlling the corresponding additional controlled equipment and/or controlled actuators such as valves, pumps, tanks, manifolds and any other in order to react when an undesired parameter value is detected during the fine blanking process. In this manner the additional controlled equipment or actuators can be controlled to compensate or modify the fine blanking process conditions to avoid the corresponding undesired effects in the process. In this manner the above explained undesired effects of fluid changes of certain components during operation can be minimized.

According to a further embodiment, the controller may be configured to control the temperature of cooling fluid through the at least one cooling channel on basis of measurement data received by at least one sensor, preferably at least one temperature sensor. In this way the measurement data, for example the temperature data, obtained by the sensors can be used to actively control the cooling fluid flow, and thus achieve the desired temperature regulation. A dynamic monitoring and cooling system can thus be implemented. By monitoring the different parameters with the corresponding applied sensors, like temperature, viscosity, pressure, flow and other sensors, during the process, a dynamic control "just in time" is possible to achieve a highly accurate fine blanking process, and in consequence highly accurate produced parts. More specifically, the temperature for example of the vertical guide sections can be adjusted such that they remain in the temperature range optimal for the chosen tolerance level between the engaging guide sections. Possible deviations of temperature during the process, be this merely overtime, or also due to different fine blanking tools and products to be produced, can be counteracted and evened out on basis of this control. Additional independent monitoring and control of single components is possible by means of independent open or closed loop sub-controls that can be exerted by independent controllers or linked to a main controller, for example over independent press ram areas, over different guide elements and others while this provides the press ram, the press frame, the guide elements and the press drive with a higher accurate control and fine blanking process efficiency.

Generally, the controller may be configured to actively monitor and control parameters such as temperature, pressure, force, position, acceleration, deformation, fluid flow, fluid viscosity and others over the line blanking press components and apply controlled actions over the fine blanking press components, like for example the compensated controlled press ram profile deformation, to achieve an optimal fine blanking process.

BRIEF DESCRIPTION OF THE DRAWINGS

Embodiments of the invention will be explained in more detail below with reference to the following drawings, showing schematically.

In the drawings the same reference numerals shall denote identical or functionally identical parts.

DETAILED DESCRIPTION OF THE INVENTION

Figure 1:
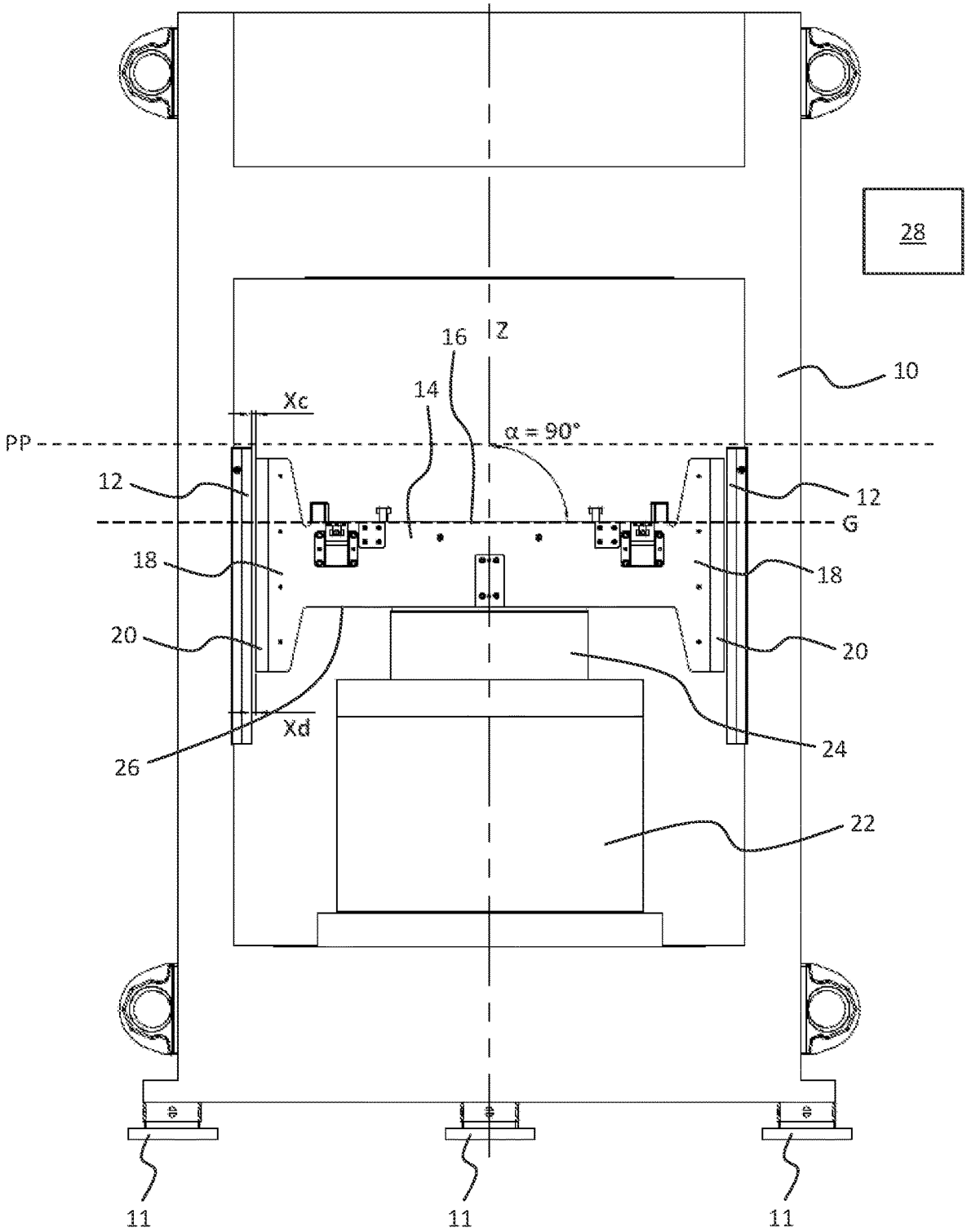
FIG. 1 illustrates a partial cross-section side view of an embodiment of a fine blanking press.

The fine blanking press shown in FIG. 1 comprises a press frame 10 with feet 11 for positioning on a floor. On opposite inner sides facing one another, the press frame 10 comprises vertically extending guide elements 12, for example slides or rails. Inside the press frame 10 a press ram is arranged vertically moveable. The press ram comprises a ram plate section 14 with an upper side 16 which is configured to carry a fine blanking tool. The press ram further comprises guide sections 18 arranged on two opposite sides of the ram plate section 14. The guide sections 18 each comprise vertically extending guide elements 20, comprising for example also slides or rails, engaging with the vertically extending guide elements 12 of the press frame 10 for guiding vertical movement of the press ram inside the press frame 10 along the axis Z in FIG. 1. As can be seen in FIG. 1, the upper side 16 of the ram plate section 14 is arranged at an angle $\alpha$ of 90° towards the vertical axis Z. It can further be seen that the upper side 16 of the ram plate section 14 is arranged at an angle of 0° with regard to the horizontal axis G. Furthermore, a sliding tolerance gap between the vertically extending guide elements 12 of the press frame 10 and the vertically extending guide elements 20 of the guide sections 18 of the press frame at an upper side is shown at XC and at a lower side is shown at Xd. In the operating position shown in FIG. 1, XC equals Xd.

Further, a press drive 22 is provided comprising a hydraulic cylinder 24 for vertically driving the press ram in operation of the fine blanking press. The press ram, more specifically the fine blanking tool to be arranged on the upper side 16 of the ram plate section 14, thereby interacts with a working table to be arranged above the press ram in order to fine blank a process material being fed to the fine blanking press in operation along a process plane PP. The process material may for example be a metal sheet being unwound from a coil. Consequently, the fine blanking press may comprise a feeding mechanism, for example driven feeding rollers, for feeding the process material to the fine blanking press in the process plane PP. The fine blanking press may further comprise a chopping unit for chopping scrap material after the fine blanking process. Furthermore, cushions may be provided in the press ram, in particular the ram plate section 14, and/or in the working table.

As can be seen in FIG. 1, the vertical guide sections 18 of the press ram extend to a vertically higher level than the upper side 16 of the ram plate section on both opposite sides of the ram plate section 14. The guide sections 18 further extend also to a vertically lower level than the lower side 26 of the ram plate section 14 on both opposite sides of the ram plate section 14. In this manner, the effective guiding area, formed by the engagement of the vertical guide elements 20 of the guide sections 18 with the vertical guide elements 12 of the press frame 10 is considerably larger than the height of the ram plate section 14. The ram plate section 14 together with the vertical guide sections 18 thereby forms an H-shape, as can be seen well in FIG. 1. A controller 28 for controlling operation of the fine blanking press shown in FIG. 1 can be seen at reference numeral 28.

Figure 2:
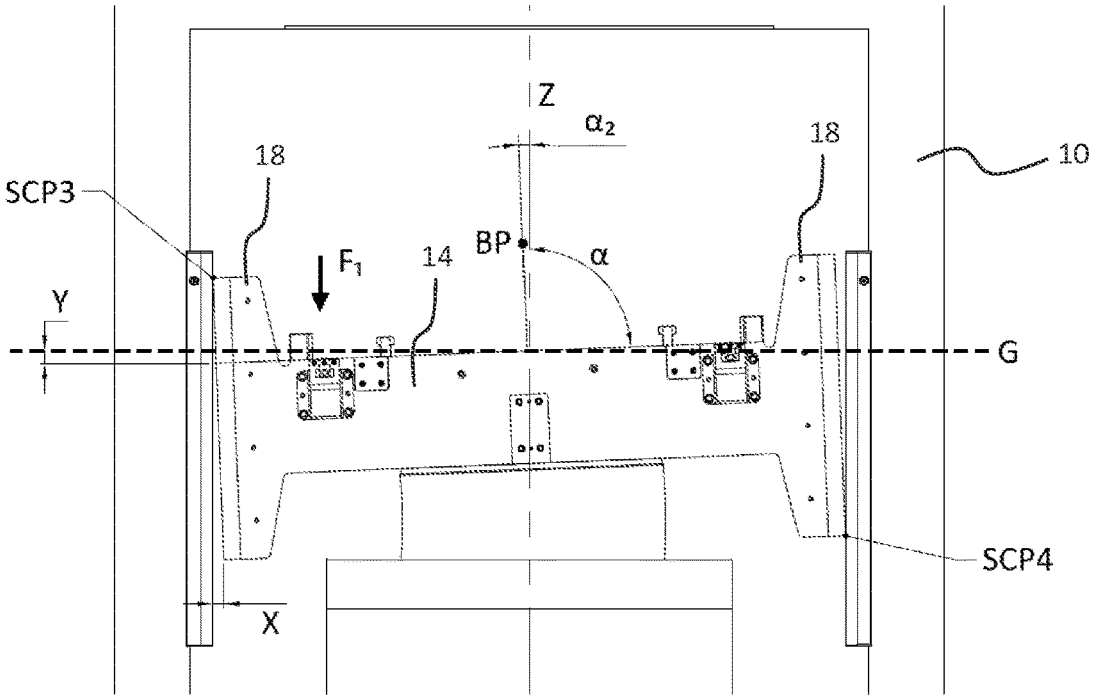
FIG. 2 illustrates the embodiment of the fine blanking press of FIG. 1 upon the occurrence of uneven forces.

FIG. 2 shows a situation which may occur during operation in which an uneven force acts on the press ram. In FIG. 2 this is shown by force F1 acting on the left side of the ram plate section 14. This in turn leads to a small tilting of the press ram with regard to the horizontal axis G, as shown in FIG. 2 at reference Y, whereby the tilting is possible until the guide contact points SCP 3 and SCP 4 are reached. Due to the enlarged guiding area the allowed tilting is much smaller than in prior art press rams. Accordingly, also the tolerance gap X shown in FIG. 2 is much smaller. The blanking point BP is only very slightly displaced with regard to the vertical axis Z, namely by the angle $\alpha$2.

As explained above, a number of sensors not limited in their number or their type may be provided on different components of the inventive fine blanking press. This is shown in FIGS. 3 to 7 for different embodiments, which may be combined with one another, and with the embodiments shown in the further Figures in any possible manner.

Figure 3:
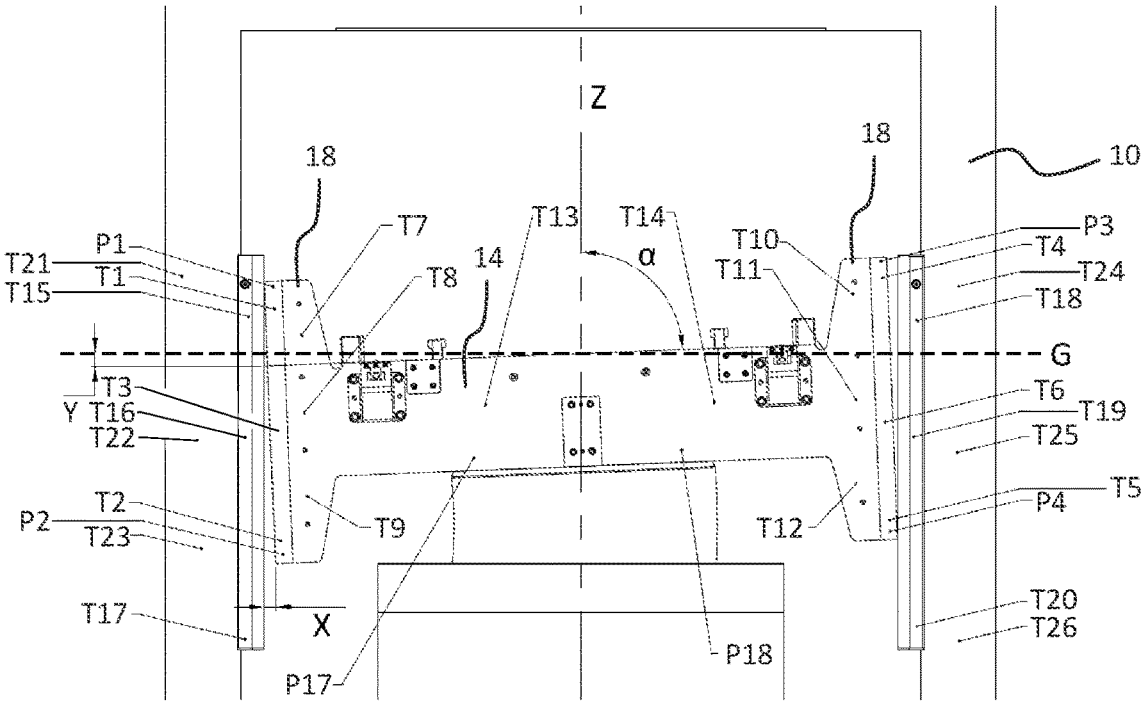
FIG. 3 illustrates the embodiment of the fine blanking press of FIG. 2 including sensors.

For example in FIG. 3 a number of pressure sensors P1 to P18 are provided on different components and different positions of the fine blanking press, more specifically the press ram with its ram plate section 14 and guide sections 18, as well as on the press frame 10. Further, several temperature sensors T1 to T26 are shown provided also on different components of the fine blanking press.

Figure 4:
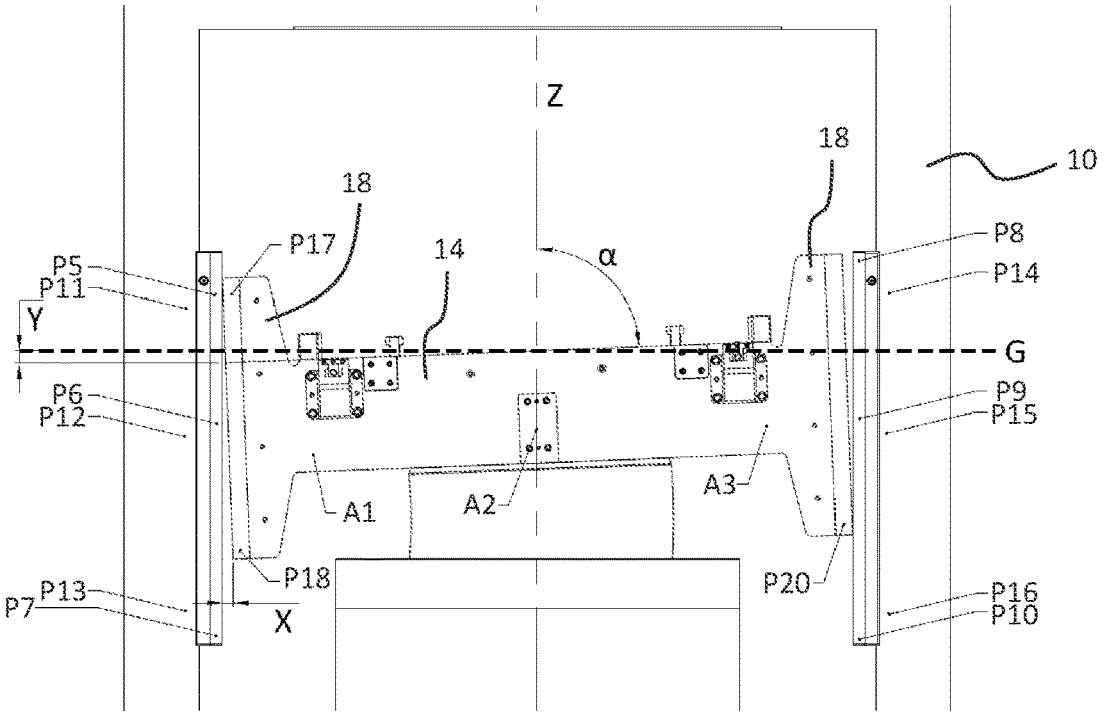
FIG. 4 illustrates the embodiment of the fine blanking press of FIG. 2 including further sensors.

In FIG. 4 a number of acceleration sensors A1 to A3, as well as a number of pressure sensors P5 to P20 are shown arranged on different components of the line blanking press.

Figure 5:
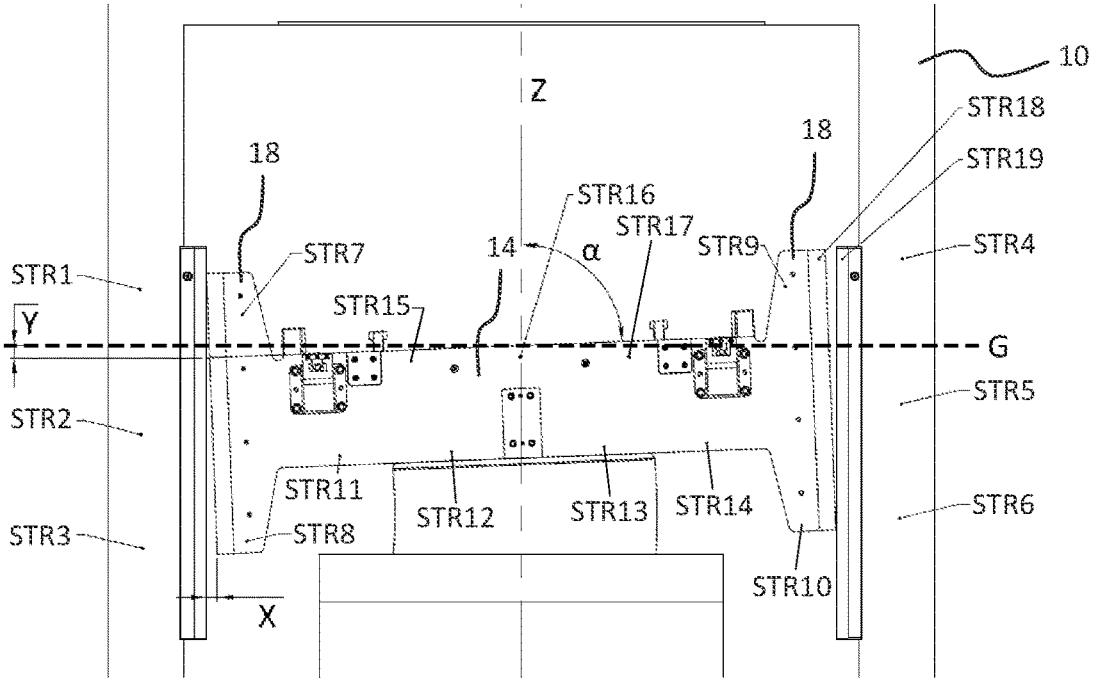
FIG. 5 illustrates the embodiment of the fine blanking press of FIG. 2 including further sensors.

In FIG. 5 a number of strain gauge sensors STR1 to STR19 are shown provided on different components of the fine blanking press.

Figure 6:
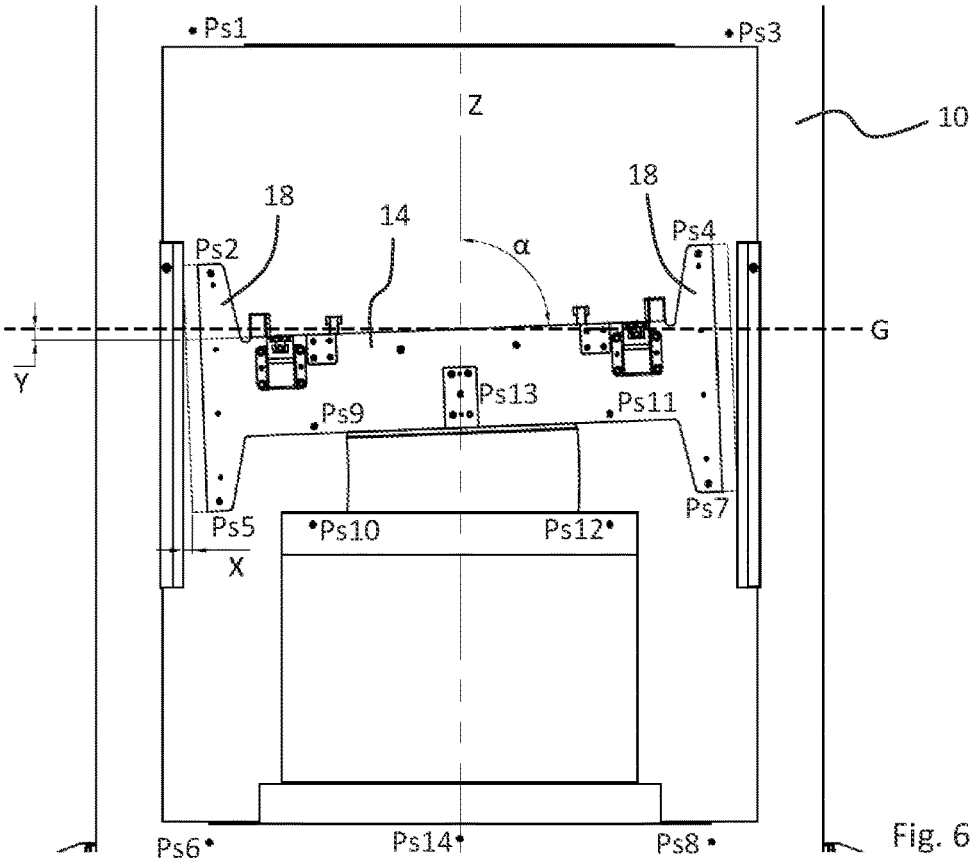
FIG. 6 illustrates the embodiment of the fine blanking press of FIG. 1 upon the occurrence of uneven forces and including sensors.

In FIG. 6 a number of position sensors PS1 to PS14 are shown arranged on different components of the fine blanking press.

Figure 7:
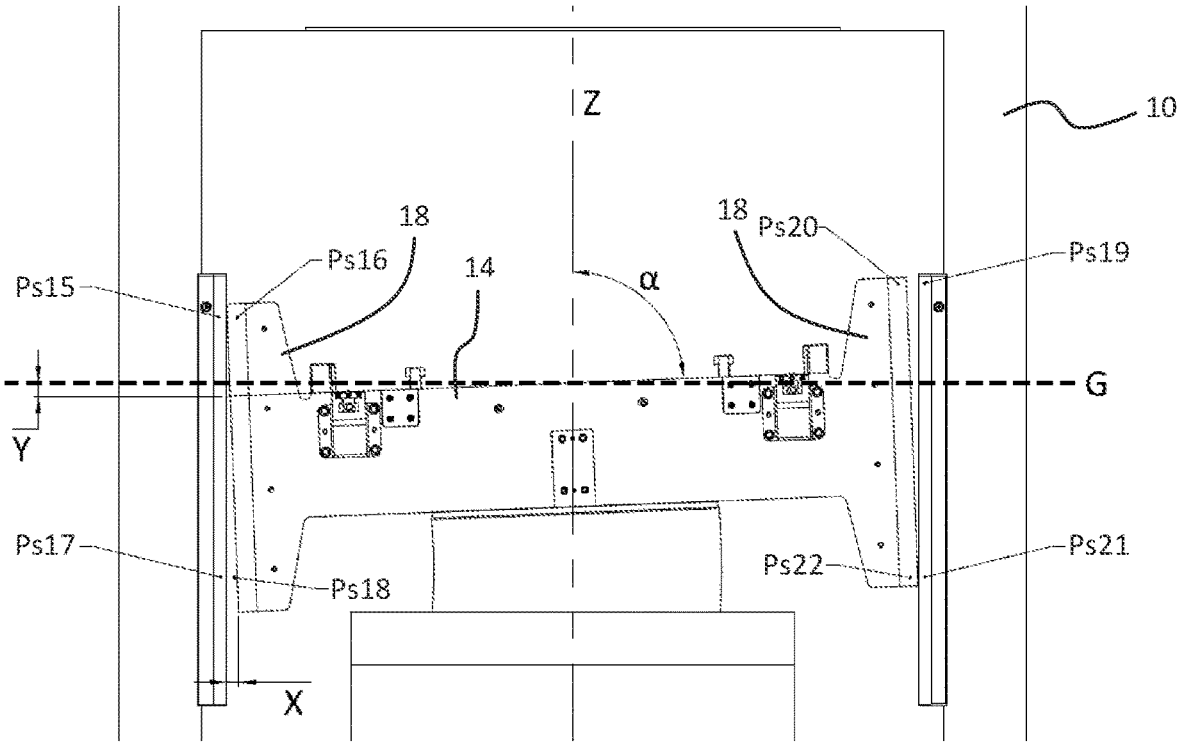
FIG. 7 illustrates the embodiment of the fine blanking press of FIG. 2 including further sensors.

In FIG. 7 further position sensors PS15 to PS22 are shown arranged on different components of the fine blanking press.

Figure 8:
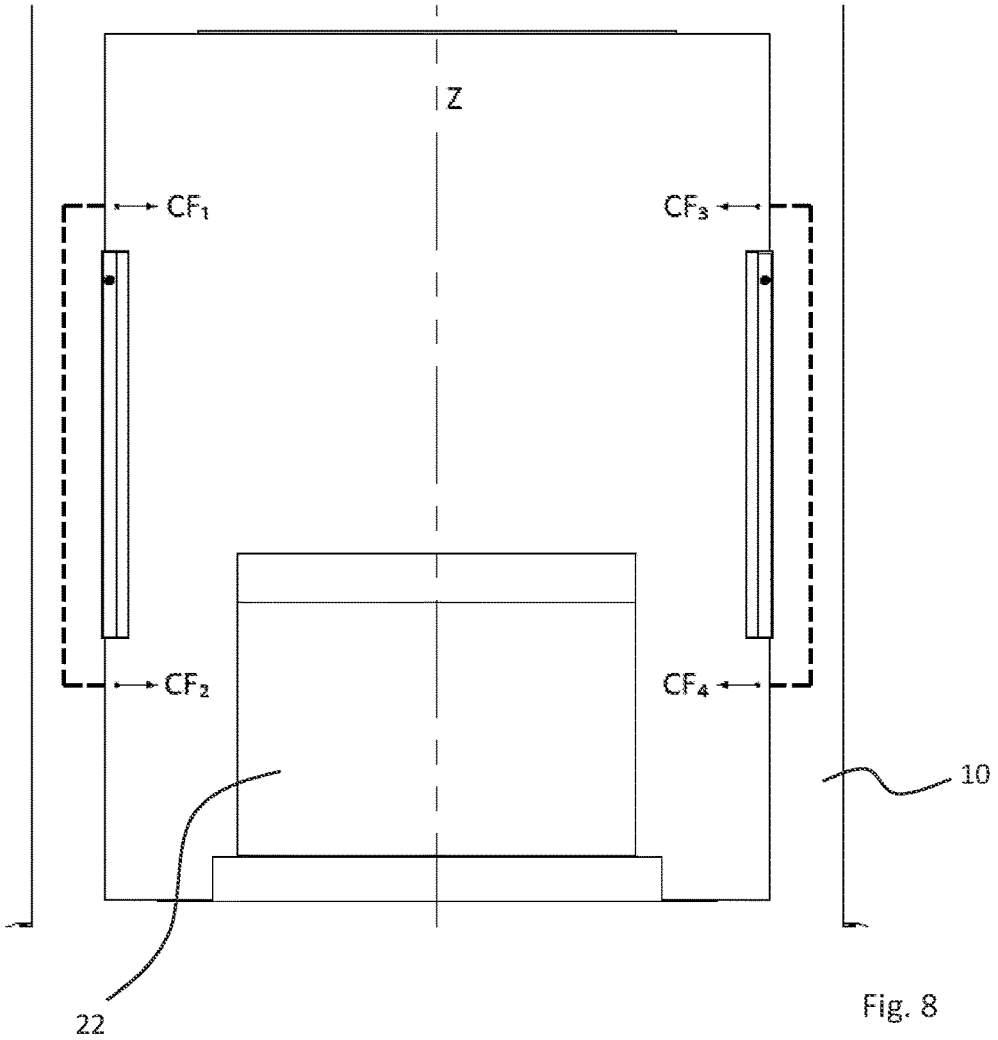
FIG. 8 illustrates a partial view of an embodiment of a press frame of the fine blanking press of FIG. 1 including cooling channels.
Figure 9:
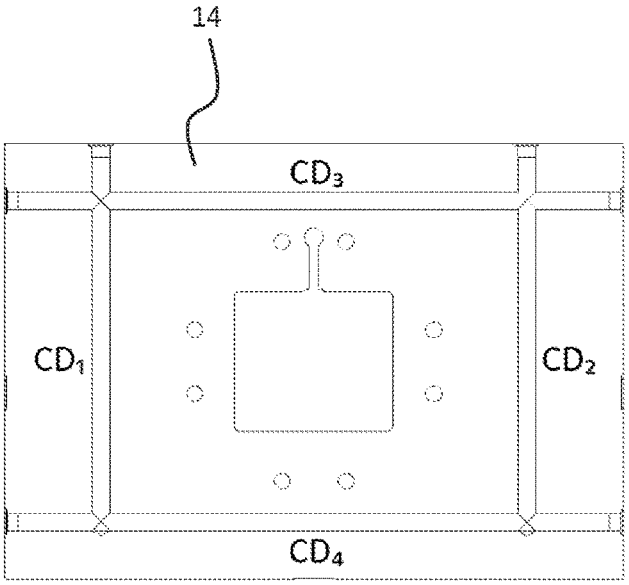
FIG. 9 illustrates an embodiment of a ram plate section of the embodiment of the fine blanking press of FIG. 1 including cooling channels.

In FIG. 8, where the press ram is not shown for explanational purposes, an embodiment is shown with cooling channels CF1 to CF4 in the press frame 10. In FIG. 9 an embodiment is shown with cooling channels CD1 to CD4 in the ram plate section 14 of the press ram.

Measurement data of all sensors arranged on the inventive fine blanking press may be fed to the controller 28 of fine blanking press. On this basis the controller 28 may control the fine blanking press in order to achieve a desired process and thus optimum quality of the produced parts. For example, the controller 28 may control the temperature of cooling fluid through the cooling channels CF1 to CF4 and CD1 to CD4 based on measurement data received from sensors, for example the temperature sensors. In this manner, the temperature of the press components can be kept within a desired temperature range at all times by means of a controlled equipment like, but not limited to, heat exchangers, heaters, chillers, or the like. The controller 28 may carry out a closed loop control but as well an open loop control is possible in terms of system cost reduction.

LIST OF REFERENCE NUMERALS

10 press frame
11 feet
12 guide elements
14 ram plate section
16 upper side
18 guide sections
20 guide elements
22 press drive
24 hydraulic cylinder
26 lower side
28 controller

The invention claimed is:

1. A press ram for a fine blanking press, the press ram comprising:

a ram plate section configured to carry a fine blanking tool, the ram plate section comprising, an upper surface, a lower surface, and two opposing side surfaces; and at least two guide sections positioned on the two opposing side surfaces of the ram plate section and configured to guide movement of the press ram relative to a press frame during a fine blanking process, wherein the at least two guide sections extend in a vertical direction to a level that is higher than the upper surface of the ram plate section, wherein the ram plate section and the at least two guide sections are formed as separate components, wherein a position of the at least two guide sections is configured to be adjusted vertically with respect to the ram plate section, wherein the at least two guide sections extend in the vertical direction to a process plane, wherein process material is fed along the process plane during operation of the fine blanking press, and wherein the at least two guide sections each define a central recess configured to accommodate the process material to be fine blanked.

2. The press ram according to claim 1, wherein each of the at least two the guide sections comprises at least one guide element extending in the vertical direction, wherein the at least one guide element is configured to engage one of the at least two guide elements of the press frame of the fine blanking press.

3. The press ram according to claim 2, wherein a gap is defined between each guide element of the at least two guide sections and corresponding guide elements of the press ram of the press frame of the fine blanking press, wherein the gap is configured to be adjusted manually or automatically.

4. The press ram according to claim 1, wherein the at least two guide sections further extend in the vertical direction to a level that is lower than the lower surface of the ram plate section.

5. The press ram according to claim 1, wherein the at least two guide sections are positioned symmetrically on the opposing side surfaces of the ram plate section.

6. The press ram according to claim 1, wherein the press ram is comprised of one or more metals, metal alloys, non-metal alloys, composite materials, temperature insulating materials, ceramics, plastics, rubbers, and epoxy chemical-based components.

7. The press ram according to one claim 1, wherein at least a portion of the press ram is comprised of different material sub-structures.

8. The press ram according to claim 1, wherein components of the press ram are formed using at least one of forging, casting, welding, 3D printing, molding, and mold injection.

* * * * *